US011235336B2

(12) United States Patent
Enderle et al.

(10) Patent No.: US 11,235,336 B2
(45) Date of Patent: Feb. 1, 2022

(54) AGITATOR BALL MILL AND METHOD FOR OPERATING AN AGITATOR BALL MILL

(71) Applicant: NETZSCH-Feinmahltechnik GmbH, Selb (DE)

(72) Inventors: Udo Enderle, Arzberg (DE); Claus Simon, Alzenau (DE); Sergio Soria, Banyeres del Penedès (ES)

(73) Assignee: NETZSCH-Feinmahltechnik GmbH, Selb (DE)

( * ) Notice: Subject to any disclaimer, the term of this patent is extended or adjusted under 35 U.S.C. 154(b) by 129 days.

(21) Appl. No.: 16/570,720

(22) Filed: Sep. 13, 2019

(65) Prior Publication Data

US 2020/0094259 A1 Mar. 26, 2020

(30) Foreign Application Priority Data

Sep. 20, 2018 (DE) ..... 102018123096.6

(51) Int. Cl.

| | |
|---|---|
| ***B02C 17/02*** | (2006.01) |
| ***B02C 17/16*** | (2006.01) |
| ***B02C 17/18*** | (2006.01) |
| ***B02C 17/24*** | (2006.01) |
| *B07B 7/083* | (2006.01) |

(52) U.S. Cl.

CPC ..... *B02C 17/161* (2013.01); *B02C 17/02* (2013.01); *B02C 17/181* (2013.01); *B02C 17/1885* (2013.01); *B02C 17/24* (2013.01); *B02C 17/184* (2013.01); *B07B 7/083* (2013.01)

(58) Field of Classification Search

CPC ... B02C 17/161; B02C 17/186; B02C 17/181; B02C 17/1885; B02C 17/24; B02C 17/184; B02C 17/1835; B02C 17/16; B02C 17/163; B02C 17/10

See application file for complete search history.

(56) References Cited

U.S. PATENT DOCUMENTS 5,333,804 A * 8/1994 Liebert ..... B02C 17/16 241/172
5,474,237 A * 12/1995 Bishop ..... B02C 17/161 241/171

(Continued)

FOREIGN PATENT DOCUMENTS

| | | |
|---|---|---|
| DE | 102012013279 A1 | 1/2014 |
| DE | 102013021757 A1 | 6/2015 |
| DE | 102015112760 A | 2/2017 |

*Primary Examiner* — Faye Francis
(74) *Attorney, Agent, or Firm* — Whitmyer IP Group LLC

(57) ABSTRACT

An agitator ball mill including an in particular horizontal grinding container, which has a first end area having a grinding material inlet and a second end area having a grinding material outlet, and a method for operating an agitator ball mill. The agitator ball mill includes a shaft, which can be rotated in the grinding container or in the grinding chamber, respectively, by means of a drive unit and which is formed as agitator shaft at least in sections and which is equipped with agitator elements, as well as a separating device. The separating device includes a classifier rotor, which is arranged on the agitator shaft axially spaced apart from the grinding material outlet and has a rotatable rotor cage, as well as a screen unit, which is arranged within the rotor cage and which is fastened to the classifier rotor.

22 Claims, 3 Drawing Sheets

(56) References Cited

U.S. PATENT DOCUMENTS 5,984,213 A * 11/1999 Woodall ..... B02C 17/16 241/171
7,374,116 B2 * 5/2008 Ishikawa ..... B02C 17/16 241/171
7,588,205 B2 * 9/2009 Ishikawa ..... B02C 17/16 241/171
8,002,213 B2 * 8/2011 Stehr ..... B02C 17/161 241/171
8,702,023 B2 * 4/2014 Enderle ..... B02C 17/161 241/171
8,814,071 B2 * 8/2014 Jeker ..... B02C 17/161 241/21
9,505,008 B2 * 11/2016 Nied ..... B02C 17/186
10,279,353 B2 * 5/2019 Nied ..... B02C 17/161
2006/0261201 A1 * 11/2006 Ishikawa ..... B02C 17/16 241/171
2008/0245910 A1 * 10/2008 Ishikawa ..... B02C 17/16 241/68
2009/0072060 A1 * 3/2009 Pausch ..... B02C 17/161 241/171
2009/0212141 A1 * 8/2009 Taylor ..... B02C 17/161 241/22
2010/0127108 A1 * 5/2010 Harbs ..... B02C 17/161 241/152.2
2011/0168814 A1 * 7/2011 Brook-Levinson ..... B02C 17/161 241/21
2011/0226878 A1 * 9/2011 Martin ..... B07B 1/06 241/25
2013/0233953 A1 * 9/2013 Enderle ..... B02C 17/16 241/38
2014/0048632 A1 * 2/2014 Pausch ..... B02C 17/161 241/22
2015/0102139 A1 * 4/2015 Nied ..... B02C 17/1835 241/12
2015/0174583 A1 * 6/2015 Nied ..... B02C 17/1835 241/30
2018/0104699 A1 * 4/2018 Simons ..... B02C 17/20

* cited by examiner

AGITATOR BALL MILL AND METHOD FOR OPERATING AN AGITATOR BALL MILL

TECHNICAL FIELD

The present invention relates to an in particular horizontal agitator ball mill as well as to a method for operating such an agitator ball mill according to the features of the independent claims.

BACKGROUND

The present invention relates to an in particular horizontal agitator ball mill for grinding dry product. An agitator ball mill is a machine for the coarse, fine and finest communication or homogenization of grinding material. An agitator ball mill consists of a non-rotatable grinding container comprising an agitator shaft, arranged therein mostly axially parallel and in the center, of a bearing and of a drive unit. The grinding container is mostly formed cylindrically and is usually between 70% and 90% filled with grinding bodies. An agitator, which consists of a rotatably supported agitator shaft comprising agitator elements arranged thereon and which ensures an intensive movement of the grinding bodies, is provided within the grinding container. Known agitator ball mills are loaded through a central opening in one of the end walls. Alternatively, the product inlet can also take place directly radially or tangentially via the grinding cylinder. The grinding material is conveyed continuously in and through the grinding chamber. The solids are thereby comminuted or dispersed, respectively, by means of impact and shear forces between the grinding bodies. The discharge of the finished product is a function of the design and takes place, for example, at the mill end. In the case of relatively fine and free-flowing, mostly spherical product particles, the axial product transport in the grinding cylinder can take place solely by means of gravitational forces. The product, however, is usually conveyed through the grinding cylinder by means of a fluid, which is preferably formed as transport air flow, wherein the grinding bodies are to remain in the grinding chamber of the agitator ball mill in response to guiding the product and the fluid out of the agitator ball mill. This is attained in particular by means of a systematic separation of the grinding bodies within the agitator ball mill, for example by using a suitable separating device.

An agitator ball mill comprising a cantilever-mounted rotor is disclosed by DE 10 2013 021 757 A1. The rotor has an axis of rotation and is cantilever-mounted to a bearing, from which a free, subsequently non-mounted rotor end is defined along the axis of rotation A. A plurality of agitator elements, which are spaced apart from one another and by means of which the grinding bodies located in the grinding chamber of the agitator ball mill are set in rotation, is arranged on the agitator shaft. A gap is formed between the rotor end face and the opposite rotor side or the housing as stator, respectively. As soon as the grinding material is completely ground, it can reach into the grinding material outlet via the gap and can thus leave the grinding chamber. It is disadvantageous, however, that the cantilever-mounted end is arranged at the grinding material outlet and the bearing-side end is arranged at the grinding material inlet. There is also the risk that, in addition to grinding material, the grinding bodies as such might also leave the grinding chamber through the gap.

An agitator ball mill comprising a separating device is known from DE 10 2015 112 760 B4, which is arranged upstream of the grinding material outlet. The separating device comprises a screen unit, which is arranged in a stationary manner and through which at least particles of at least a portion of the product/grinding body mixture up to a certain diameter can pass. The separating device further comprises a classifier rotor, which has a support plate, which is rigidly mounted on the agitator shaft of the agitator ball mill, comprising coupled attachments. The attachments form a rotor cage, which rotates about the screen unit, which is arranged upstream of the grinding material outlet in a stationary manner. The rotor cage comprising the attachments contributes to protecting the screen unit against the grinding bodies located in the grinding chamber, as well as to effecting a certain flow behavior of the product/fluid mixture in the area of the screen unit. A comparatively similar agitator ball mill is disclosed by DE 10 2012 013 279 A1.

It is problematic in the case of the separating device known from the prior art that the grinding bodies are pushed in the direction of the inner wall of the grinding container by means of rotation of the agitator shaft, so that said grinding bodies concentrate axially along the inner wall of the grinding container. With the overlapped internal flow direction of the product-fluid mixture and the drag forces on the grinding bodies associated therewith, this leads, by nature, to an increased concentration of the grinding bodies in the area around the support plate of the classifier rotor and thus to a clogging of the product discharge as well as to an increased wear.

SUMMARY

The invention is thus based on the object of providing an agitator ball mill and a method for operating an agitator ball mill, in the case of which the grinding material discharge can be improved as compared to the known solutions, and in the case of which the wear at the screen unit can be reduced, and a compression of the grinding bodies, which are located in the grinding chamber, can be prevented.

The above object is solved by means of an agitator ball mill as well as by means of a method for operating an agitator ball mill comprising the features of the independent claims. Further advantageous embodiments and further developments of the invention are specified in the respective dependent claims.

To solve the mentioned object, the invention proposes an in particular horizontal agitator ball mill comprising an in particular cylindrically formed grinding container, which has a grinding material inlet and a grinding material outlet. The grinding material inlet is in particular provided at a first end area of the grinding container, and the grinding material outlet is formed at an opposite second end area of the grinding container.

A negative pressure, which can be created and set by means of corresponding vacuum pumps, suction blowers or the like, can preferably prevail in the grinding container or in the grinding chamber, respectively, as compared to the atmosphere.

Up to between 70% and 90% of the grinding container or of the grinding chamber, respectively, can preferably be filled with grinding bodies, which are formed spherically, for example. The grinding bodies can optionally also have any other shape. The grinding bodies are essential for the comminution of the grinding material, which is supplied via the grinding material inlet, and act as comminution tool. The grinding bodies can preferably be formed to be smaller than 20 mm, in particular smaller than 12 mm.

The agitator ball mill comprises a shaft, which can be rotated in the grinding container or in the grinding chamber, respectively, by means of a drive unit and which is formed as agitator shaft at least in sections and which is equipped with agitator elements. The shaft can extend along the longitudinal extension of the grinding container at least in sections and into the grinding material inlet and/or into the grinding material outlet.

The drive unit of the agitator shaft can preferably be arranged at the second end area of the grinding container comprising the grinding material outlet or on the side of the grinding material outlet, respectively. The agitator shaft preferably comprises a plurality of agitator elements, which are each arranged evenly spaced apart from one another. The agitator elements can in particular extend radially from an outer jacket surface of the agitator shaft, wherein a distance between a free end of the agitator elements and an inner jacket surface of the grinding container, preferably completely, is each at least two and a half times the diameter of the grinding bodies. The distance between the free end of the agitator elements and the inner jacket surface of the grinding container can also be referred to as grinding gap.

The agitator elements can preferably be fastened to an outer jacket surface of the agitator shaft in a rotationally fixed manner. The agitator elements can preferably be fastened to the outer jacket surface of the agitator shaft by means of non-positive and/or positive connection. The agitator elements can serve the purpose of setting the grinding bodies located in the grinding chamber into motion and to thus provide them with energy, which serves to comminute the grinding material supplied via the grinding material inlet.

The grinding bodies can in particular be set in motion in so-called grinding zones, which grinding zones are each defined as space between two agitator elements. The grinding material to be ground, which is supplied via the grinding material inlet and which is to be ground, can in each case pass these grinding zones and can be comminuted on the way from the grinding material inlet to the grinding material outlet. By supplying the grinding material to be ground and by discharging the completely ground grinding material, a flow can set in. The agitator elements can be formed, for example, in the shape of disks, such as solid disks, perforated disks with or without axial or radial elevations, pins or other elements.

To separate the completely comminuted, in particular ground, grinding material from the grinding bodies, the agitator ball mill comprises a separating device, which is preferably arranged upstream of the grinding material outlet. The separating device comprises a classifier rotor, which is arranged on the agitator shaft axially spaced apart from the grinding material outlet and has a rotatable rotor cage. The rotor cage can contribute to the grinding bodies, which are located in the area of the separating device being moved and/or centrifuged radially in the direction of the inner wall of the grinding container.

The separating device furthermore comprises a screen unit, which is arranged within the rotor cage and which is fastened to the classifier rotor. By fastening the screen unit to the classifier rotor, the screen unit is formed so as to rotate. The screen unit can in particular rotate together with the rotor cage, i.e. the rotor cage and the screen unit can rotate at the same speed, because the speed of the rotor cage can be transferred to the screen unit. The completely ground grinding material can thus leave the grinding container or grinding chamber, respectively, via the screen unit with a certain diameter and, alternatively, also a fluid flow, such as, for example, a first fluid flow or at least a part of the first fluid flow, respectively, in that said grinding material reaches into the grinding material outlet, while the grinding bodies remain or are retained, respectively, in the grinding container or in the grinding chamber, respectively.

Due to the screen unit, which rotates with the rotor cage, it follows in an advantageous manner that the grinding bodies between screen unit and inner wall of the grinding container do not compress rigidly. The grinding bodies are instead loosened while being permanently held in motion and are centrifuged radially in the direction of the inner wall of the grinding container. The wear of and/or damages to the screen unit can simultaneously be reduced thereby.

The rotor cage comprising the screen unit fastened thereto can preferably be driven via the agitator shaft, so that the rotor cage comprising the screen unit and the agitator shaft are driven at the same speed. Torque transmission devices or the like can be provided, for example, for this purpose, by means of which a torque of the shaft or agitator shaft, respectively, can be transmitted to the rotor cage. Alternatively, the rotor cage can be assigned its own drive unit, so that the rotor cage comprising the screen unit can be driven independently of the agitator shaft, i.e. the rotor cage comprising the screen unit fastened thereto and the agitator shaft can be driven or operated, respectively, at different or at the same speeds.

The screen unit can be formed, for example, conically or conically folded in the shape of a star. An inner diameter of the screen unit can thereby increase in the direction of the grinding material outlet, wherein a maximum inner diameter is formed to be smaller than 95% of the grinding container inner diameter. Due to the conical shape of the screen unit, a large screen surface, but in particular also a large passage surface can be provided in the area of the support plate of the classifier rotor for the completely ground grinding material. The screen unit can optionally be formed in any further shape, which appears to be appropriate for the use in the agitator ball mill according to the invention.

It can be provided that the rotor cage comprises a flange, which sits on the agitator shaft, comprising a support plate, i.e. it can be provided that a diameter of the classifier rotor increases in the direction of the grinding chamber outlet. The support plate can in particular be an end face of the classifier rotor with the smallest diameter of the classifier rotor. At least two rotor fingers are or can be fastened, respectively, to the support plate. At least three, four or five or several rotor fingers are or can optionally also be fastened, respectively, to the support plate. The at least two rotor fingers are in particular each fastened mechanically, preferably releasably, to the support plate, so that they can be exchanged, if necessary. It can be provided thereby that the at least two rotor fingers are each arranged at least approximately on the outer circumference of the support plate. In addition, it is important to point out at this time that the rotor cage is formed by the support plate comprising the at least two rotor fingers fastened thereto.

The at least two rotor fingers can be formed of identical length in the longitudinal direction, wherein a diameter and/or a width and/or a height of the at least two rotor fingers along the longitudinal extension thereof can increase or is identical. In the case of a formation of the same size in the longitudinal direction or of the same length, respectively, at least one ring element, for example in the shape of a disk, can be provided at the free end of the at least two rotor fingers. The at least one ring element can comprise a centrically arranged bore, the inner diameter of which is larger than an outer diameter of the shaft or agitator shaft, respectively. An outer diameter of the at least one ring element can be formed so as to correspond to at least a diameter or a distance, respectively, between the at least two rotor fingers, or to be larger.

It can further be provided that the rotor cage is assigned a stationary base, which is arranged on an inner side of the second end area of the grinding container. The stationary base can be, for example, a circular or tubular element, respectively, which protrudes/protrude into the grinding chamber at least in sections. The stationary base can preferably protrude into the grinding chamber at least approximately perpendicularly from an inner side of the second end area of the grinding container, i.e. the stationary base can extend parallel to the shaft, in particular to the classifier rotor at least in sections.

The rotor cage, in particular the free end of the at least two rotor fingers or the end face of the at least one ring element pointing towards the grinding material outlet, can preferably be arranged to the stationary base, in particular arranged at a distance, in such a manner that a distance or a gap, respectively, is formed to be smaller than 0.5-times, preferably smaller than 0.3-times the diameter of the grinding body. It can be prevented due to the formed distance that grinding material, which has not been ground completely, and/or grinding bodies reach into the grinding material outlet and clog the latter and/or damage the screen unit.

It can further be provided that the classifier rotor has a smaller diameter in the area of the support plate than in the area of the ring element.

It can further be provided that the screen unit is fixed to the support plate of the flange. The screen unit can in particular be fastened to the support plate by means of a non-positive, positive connection and/or by means of a substance-to-substance bond, preferably releasably, i.e. the screen unit can be exchanged in a simple manner in the case of wear. A torque of the rotor cage can be transmitted to the screen unit via the fixation of the screen unit to the support plate, i.e. the rotor cage and the screen unit can rotate together, in particular at the same speed. The rotor cage can thus act as a type of torque transmission device.

So that the completely ground grinding material can reach into the grinding material outlet via the screen unit, the screen unit can comprise a plurality of openings. The openings can have a round, oval, angled or irregular cross section. The openings can preferably be formed in the shape of axial elongated holes. The size of the openings of the screen unit should thereby in each case be selected in such a way that the openings are each formed to be smaller than 70% of the diameter of the grinding bodies, i.e. the openings can maximally have 0.7-times the opening width of the grinding body diameter and/or grinding body height and/or of the grinding body length. It can be prevented in this way that grinding bodies reach into the grinding material outlet.

It can further be provided that the screen unit has a smaller enveloping outer diameter on the side facing the grinding material inlet than on the side facing the grinding material outlet or the bearing-side grinding chamber limitation, respectively.

It can further be provided that a grinding material inlet chamber is arranged upstream of the grinding material inlet. In other words, the grinding material inlet chamber can lead into a grinding material inlet arranged downstream from the grinding material inlet chamber. The grinding material inlet can be formed, for example, in the shape of an opening in the first end area of the grinding container.

It can further be provided that a grinding material outlet chamber is spatially arranged downstream from the grinding material outlet, i.e. the grinding material outlet can lead into a grinding material outlet chamber arranged downstream from the grinding material outlet. The grinding material outlet can be formed, for example, in the shape of an opening in the second end area of the grinding container. The grinding material outlet chamber can lead into a collection container, so that the completely ground grinding material can be collected and can be temporarily stored until the further handling.

In the broadest sense, the grinding material inlet chamber can be a part of the grinding material inlet, and the grinding material outlet chamber can be a part of the grinding material outlet. When reference is thus made above and also below that the shaft protrudes into the grinding material inlet and/or into the grinding material outlet at least in sections, this is to also capture or not rule out, respectively, that the shaft can also extend into the grinding material inlet chamber and/or into the grinding material outlet chamber.

The grinding material outlet can be arranged parallel and/or perpendicular to the shaft at least in sections. An opening, which runs parallel and/or perpendicular to the shaft at least in sections, can in particular be provided in the second end area of the grinding container, i.e. the grinding material outlet can be arranged below and/or above the center of the shaft or of the shaft center, respectively, and can extend downward and/or laterally.

It can further be provided that the shaft arranged in the grinding container extends into the grinding material inlet chamber and/or into the grinding material outlet chamber at least in sections. The shaft, which extends into the grinding material outlet chamber, can be formed as first screw conveyor, in particular as first screw helix, at least in sections. The grinding material can thus be transported into the grinding chamber continuously or as needed. A clogging of the grinding material inlet with grinding material, which is stuck and/or clumped together, can simultaneously be counteracted at least for the most part.

It can further be provided that the shaft within the screen unit and/or within the grinding material outlet and/or within the grinding material outlet chamber is formed as second screw conveyor, in particular as second screw helix, at least in sections. The completely ground grinding material can thus be conveyed along the grinding material outlet to the grinding material outlet chamber at least in sections with the help of the second screw conveyor, in order to prevent a clogging of the grinding material outlet.

In the case of dry agitator ball mills, a vertical grinding chamber arrangement is known, but has the problem that the grinding bodies are present in a compressed manner in the lower area of the grinding cylinder due to the force of gravity and prevent a product transport. Mill designs comprising a separation of the product/grinding body mixture outside of the grinding chamber have the disadvantage that grinding bodies have to be supplied and discharged permanently with the product, which decreases the energy efficiency of the grinding circuit. It is thus provided that the grinding container is arranged so as to be positioned horizontally. In the case of the known agitator ball mills comprising horizontally positioned grinding containers and comprising a screen unit, which is arranged in a stationary manner upstream of the grinding material outlet, the problem had arisen thus far that the grinding bodies compress in the area of the grinding material outlet and screen unit, so that the screen unit is thus damaged and, in the worst case, is no longer passable for the completely ground grinding material. Due to the screen unit, which rotates with the rotor cage, the grinding bodies can be permanently kept in motion, so that the completely ground grinding material can access the screen unit at any time and is not damaged by compressed grinding bodies.

It can also be provided that the shaft is cantilever-mounted in the grinding container. The grinding material inlet can in particular be arranged at the cantilevered end of the shaft and the grinding material outlet at the bearing-side end of the shaft. The cantilevered end can preferably be arranged at the first end area and the bearing-side end of the shaft at the second end area of the grinding container. A reverse bearing of the cantilevered shaft would optionally also be conceivable, according to which the cantilever-mounted end is arranged at the grinding material outlet and the bearing-side end at the grinding material inlet.

It can further be provided that the grinding material inlet and/or the grinding material inlet chamber is assigned a first fluid inlet opening, via which a first fluid flow, such as, for example, a first air volume flow or an inert or reactive gas, can be supplied or is supplied, respectively, into the grinding material inlet or grinding material inlet chamber, respectively, and thus into the grinding chamber of the grinding container. The first fluid flow can be supplied into the grinding material inlet or into the grinding material inlet chamber, respectively, in such a way that it mixes with the grinding material and that a first grinding material fluid flow is formed. The first fluid flow can thus serve as transport flow and can carry the grinding material from the grinding material inlet or from the grinding material inlet chamber, respectively, into the grinding chamber. It would also be conceivable that at least a part of the first fluid flow also flows along the grinding chamber and carries the grinding material, which is to be ground there and/or the completely ground grinding material all the way to the grinding material outlet. Together with the completely ground grinding material, a part of the first fluid flow can also leave the grinding chamber via the grinding material outlet in this way.

It can further be provided that the grinding material outlet and/or the grinding material outlet chamber is assigned a second fluid inlet flow, so that a second fluid flow, for example a second air volume flow or an inert or reactive gas, can be supplied to the grinding material outlet or to the grinding material outlet chamber, respectively. The second fluid flow can be supplied into the grinding material outlet or the grinding material outlet chamber, respectively, in such a way that it mixes with the completely ground grinding material and that a second grinding material fluid flow is formed. The second fluid flow can serve the purpose of carrying and of transporting the completely ground grinding material along the grinding material outlet.

It can further and/or additionally be provided that the tubular element comprises channels and/or bores, through which the second fluid flow can flow.

According to an alternative exemplary embodiment, the channels and/or bores of the tubular element can be a third fluid inlet opening, through which a third fluid flow, such as for example a third air volume flow or an inert gas or the like can flow. The third fluid flow can leave the grinding chamber in particular via the grinding material outlet.

The second and/or third fluid flow can preferably be flushed through the distance or gap, respectively, which is formed between stationary base and the rotor fingers in such a way that no grinding material or hardly completely ground grinding material can penetrate into the gap. The second and/or the third fluid flow can additionally act as flushing fluid, by means of which the screen unit can be cleaned and blown out.

The first, second and/or third fluid flow can each be created by means of a separate or external fluid source, such as, for example, by means of a separate or external air source or by means of a joint external fluid source, such as, for example, by means of a joint external air source or the like.

It can also be provided that at least one control element is in each case assigned to the first and/or second and/or third fluid inlet opening, so that the first and/or second and/or the third fluid flow can be regulated. A cross section of the first and/or second and/or third fluid inlet opening can be varied, for example by means of the control element, wherein the first and/or second and/or third fluid inlet opening are set. The at least one control element can in particular be set in such a way that the negative pressure, which prevails in the grinding chamber, remains.

It can further be provided that the first fluid flow, which flows along through the grinding material inlet, is larger than 50% of the entire fluid flow, wherein in particular the entire fluid flow can consist of the first, second and/or third fluid flow.

It can preferably be provided that the second and/or third fluid flow, which flows through the stationary base and the interval formed between stationary base and the rotor fingers is formed to be smaller than 25% of the entire fluid flow.

The invention further comprises a method for operating an above-described agitator ball mill. The agitator ball mill comprises a grinding container, which has a first end area comprising a grinding material inlet and a second end area comprising a grinding material outlet. The agitator ball mill furthermore comprises a shaft, which can be rotated in the grinding container or in the grinding chamber, respectively, by means of a drive unit, which is formed as agitator shaft at least in sections and which is equipped with agitator elements.

To separate the completely ground grinding material from the grinding bodies, a separating device is provided, which is preferably arranged axially to the grinding material outlet. The separating device comprises a classifier rotor, which is arranged on the agitator shaft axially spaced apart from the grinding material outlet and which has a rotatable rotor cage. A screen unit is arranged within the rotor cage and is fastened to the classifier rotor. When controlling the classifier rotor, the rotor cage is set in rotation. Due to the fact that the screen unit is fastened to the classifier rotor and in particular to the rotor cage, a torque of the rotor cage is transmitted to the screen unit, so that rotor cage and screen unit rotate jointly at the same speed. The rotation of the rotor cage serves the purpose that the grinding bodies, which are located in the grinding container or in the grinding chamber, respectively, are centrifuged radially in the direction of the inner wall of the grinding container, while the completely ground grinding material, in contrast, can reach into the grinding material outlet via the screen unit. This separating and transport function is supported in particular when the grinding bodies have a higher specific weight than the product to be ground, because due to the density difference, the completely ground grinding material then escapes to the inside into the grinding material outlet through the screen.

While the grinding bodies between screen unit and inner wall of the grinding container can compress and stick together in the case of a screen unit, which is arranged in a stationary manner or which is fixed, respectively, wherein the screen unit can consequently be damaged and the grinding material discharge from the grinding container via the screen unit can be prevented or clogged, respectively, the arrangement of the screen unit on the agitator shaft prevents such a compression of the grinding bodies, wherein the agitator ball mill is less susceptible to clogging in the area of the grinding material discharge. The effort for maintaining the agitator ball mill and/or the production losses for cleaning the agitator ball mill is/are significantly reduced.

It is important to mention expressly at this point that all aspects and embodiment alternatives, which were described in connection with the device according to the invention, likewise relate to or can be partial aspects of the method according to the invention. When reference is thus made to certain aspects and/or relationships and/or effects at a point in the description or also in the case of the claim definitions relating to the device according to the invention, this likewise applies for the method according to the invention. The same applies, conversely, so that all aspects and embodiment alternatives, which were described in connection with the method according to the invention, likewise also relate to or can be partial aspects of the device according to the invention. When reference is thus made to certain aspects and/or relationships and/or effects at a point in the description or also in the case of the claim definitions relating to the method according to the invention, this likewise applies for the device according to the invention.

BRIEF DESCRIPTION OF THE DRAWINGS

Exemplary embodiments are to describe the invention and its advantages in more detail below by means of the enclosed figures. The size ratios of the individual elements relative to one another in the figures do not always correspond to the actual size ratios, because some forms are illustrated in a simplified manner and other forms are illustrated in an enlarged manner in relation to other elements for better visualization.

DETAILED DESCRIPTION

Figure 1:
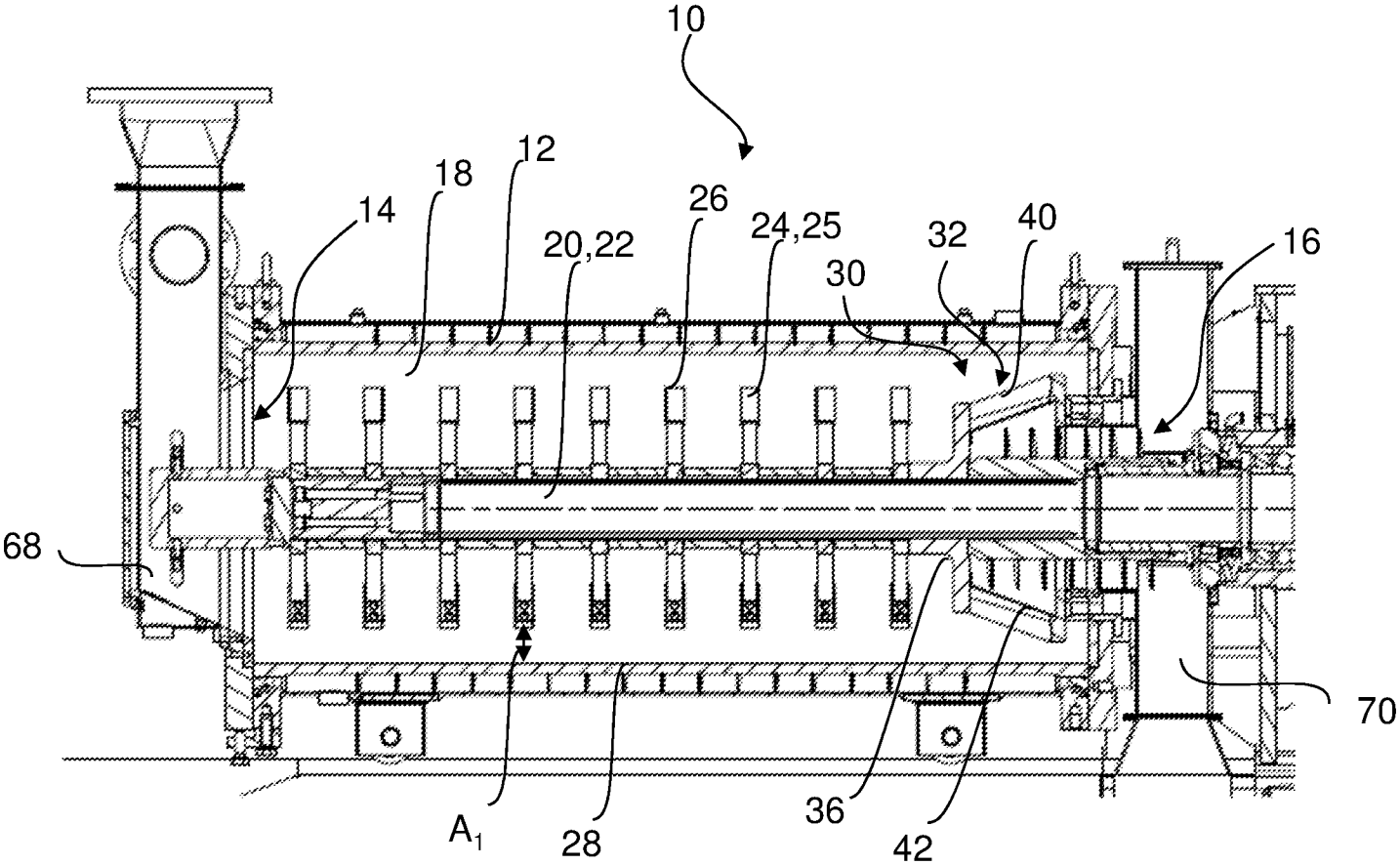
FIG. 1 shows a schematic view of a longitudinal section of an embodiment of the agitator ball mill according to the invention.

Identical reference numerals are used for elements of the invention, which are identical or have an identical effect. Furthermore, only reference numerals, which are required for the description of the respective figure, are illustrated in the individual figures for the sake of clarity. The illustrated embodiments only represent examples for how the device according to the invention could be designed, and do not represent a conclusive limitation.

FIG. 1 shows a schematic view of a longitudinal section of an embodiment of the agitator ball mill 10 according to the invention. The agitator ball mill 10 comprises a grinding container 12, which is formed cylindrically and which is supported horizontally. A negative pressure, which is set by means of a suitable vacuum pump or the like, which is not illustrated here, prevails in the grinding container 12 or in the grinding chamber 18, respectively.

The grinding container 12 has a grinding material inlet 14 and a grinding material outlet 16, which are formed by corresponding openings in the grinding container 12. The grinding material inlet 14 is provided at a first end area of the grinding container 12 (on the left in FIG. 1), and the grinding material outlet 16 is provided at an opposite second end area (on the right in FIG. 1). A grinding material inlet chamber 68 is arranged spatially upstream of the grinding material inlet 14 (see FIG. 2). A grinding material outlet chamber 70 is furthermore arranged spatially downstream from the grinding material outlet 16 (see FIG. 3). In the broadest sense, the grinding material inlet chamber 68 is an area of the grinding material inlet 14 and the grinding material outlet chamber 70 is an area of the grinding material outlet 16.

Up to between 70% and 90% of the grinding container 12 is preferably filled with grinding bodies, which are preferably formed spherically, but which can also be formed cylindrically, for example. The grinding bodies are essential for the comminution of the grinding material, which is supplied via the grinding material inlet 14, and act as comminution tool. The grinding bodies are preferably formed to be smaller than 12 mm.

The agitator ball mill 10 comprises a shaft 20, which can be rotated by means of a drive unit, which is not illustrated here and which is arranged in the grinding container 12. The drive unit of the rotatable shaft 20 is preferably located in the area of the grinding material outlet 16 or at the second end area of the grinding material container 12, respectively.

The shaft 20 is cantilever-mounted, wherein the bearing-side end of the shaft 20 is arranged in the area of the grinding material outlet 16 or grinding material outlet chamber 70, respectively, and the cantilevered end of the shaft 20 is arranged in the area of the grinding material inlet 14 or grinding material inlet chamber 68, respectively, i.e. the shaft 20 extends at least along the longitudinal extension of the grinding container 12 from the grinding material inlet chamber 68 or grinding material inlet, respectively, to the grinding material outlet chamber 70 or grinding material outlet 16, respectively.

The rotatable shaft 20 is formed as agitator shaft 22 at least in sections and is equipped with agitator elements 24. The agitator elements 24 each extend radially from an outer jacket surface of the agitator shaft 22, wherein the agitator elements 24 are each fastened to the outer jacket surface of the agitator shaft 22 in a rotationally fixed manner, in particular mechanically. The agitator elements 24 are in particular arranged evenly spaced apart from one another on the outer jacket surface of the agitator shaft 22.

According to the present embodiment, the agitator elements 24 are formed as pins 25. It would also be conceivable, however, to form the agitator elements 24 in the shape of grinding disks or the like. The agitator elements 24 in each case serve the purpose of setting the grinding bodies, which are located in the grinding chamber 18, in motion, and to thus provide them with energy, which serves to comminute the grinding material supplied via the grinding material inlet 14. The grinding bodies are set in motion in particular in so-called grinding zones, which grinding zones are in each case defined as space between two pins. The grinding material to be ground, which is supplied via the grinding material inlet 14, in each case passes through these grinding zones and is comminuted on the way from the grinding material inlet 14 to the grinding material outlet 16. By supplying the grinding material to be ground and discharging the completely ground grinding material, the flow of the grinding material is set from the grinding material inlet 14 in the direction of the grinding material outlet 16.

The agitator elements 24 each have a free end 26, which is in each case arranged at a distance from an inner wall 28 of the grinding container 12. The first distance $A_1$ between the free end 26 of the agitator elements 24 and the inner wall 28 of the grinding container 12 corresponds to at least two and a half times the average diameter of the grinding bodies.

The first distance $A_1$ between the free end and the inner wall 28 of the grinding container 12 is thus required, so that the grinding bodies can pass through this area unhindered, without compressing and/or sticking together, as it would otherwise be the case in the case of a distance, which is selected to be too small, between free end of the agitator element and inner wall 28 of the grinding container 12.

To separate the completely ground grinding material from the grinding bodies or to ensure that the grinding bodies remain in the grinding chamber 18, respectively, while the completely ground grinding material leaves the grinding chamber 16, a separating device 30 is provided, which separating device 30 is preferably arranged axially upstream of the grinding material outlet 16. The separating device 30 comprises a classifier rotor 32, which is arranged on the agitator shaft 22 axially spaced apart from the grinding material outlet 16, and has a rotatable rotor cage 34. The rotor cage 34 has a flange 36 resting on the agitator shaft 22 comprising a support plate 38 (see FIG. 3). It becomes clear from FIG. 1 or by means of the flange 36 shown in FIG. 1, respectively, that a diameter of the classifier rotor 32 increases in the direction of the grinding material outlet 16. A smallest diameter of the classifier rotor 32 is formed by the support plate 38 of the flange 36. At least two rotor fingers 40 are mechanically coupled on the outer circumference of the support plate 38.

The rotor fingers 40 are formed of identical size or of identical length, respectively, in the longitudinal direction, wherein the radial extension thereof across the length thereof preferably changes, i.e. a diameter of the rotor fingers 40 increases along the longitudinal extension thereof. It can apply thereby that a first diameter $D_1$ of the rotor finger 40 is smaller than the second diameter $D_2$ of the rotor finger 40. The rotor fingers 40 extend in particular from the support plate 38 in the direction of the grinding material outlet 16. At the free end of the rotor fingers 40, at least one ring element 44 is provided in the shape of a disk 46. The disk 46 comprises a centrically arranged bore, the inner diameter of which is larger than an outer diameter of the shaft 20 or of the agitator shaft 22, respectively. An outer diameter of the disk 46 preferably corresponds to the diameter or distance, respectively, between the at least two rotor fingers 40. A largest diameter of the classifier rotor 32 is formed by the disk 46.

The separating device 30 furthermore comprises a screen unit 42, which is arranged within the rotor cage 34 and which is fastened to the classifier rotor 32, and via which the completely ground grinding material can leave the grinding chamber 18 and the grinding bodies are retained in the grinding chamber 18. Due to the fastening of the screen unit 42 to the classifier rotor 32, the rotor cage 34 comprising the screen unit 42 fastened thereto rotates at the same speed as the agitator shaft 22. Due to the rotational movement of the rotor cage 34, flows and forces are created, so that the grinding bodies are moved or centrifuged, respectively, radially in the direction of the inner wall 28 of the grinding container 12. The area round the grinding material outlet 16 is kept free from the grinding bodies in this way.

The screen unit 42 comprises a plurality of openings, which are not illustrated here. The openings are preferably formed in the shape of axial elongated holes. The elongated holes each have a cross section, which is smaller than the grinding bodies, so that only the completely ground grinding material can pass through the openings of the screen unit 42, while the grinding bodies, in contrast, remain in the grinding chamber 18. The openings in particular have a cross section, which is formed to be smaller than 70% of the diameter of the grinding bodies.

The screen unit 42 is formed conically and is arranged within the rotor cage 34 in such a way that an outer diameter of the screen unit 42 increases in the direction of the grinding material outlet 16, wherein a maximum outer diameter of the screen unit 42 is formed to be smaller than 95% of the inner diameter of the grinding material container. Due to the spherical shape of the screen unit 42, a large surface, in particular a large passage surface, is provided for the completely ground grinding material. It goes without saying that in order to increase the surface, the screen unit 42 can consist, e.g., of a screen plate, which is folded in a star-shaped manner and the outer sleeve surface of which is formed to be conical.

The end face of the screen unit 42 pointing towards the support plate 38 preferably has two webs 48, 48', which are mechanically fixed to the support plate 38. The screen unit 42 is fixed to the support plate 38 in this way. The fastening of the screen unit 42 to the support plate 38 via the two webs 48, 48' can act in the manner of a torque transmission device, i.e. a torque of the rotor cage 34 is automatically transmitted to the screen unit 42 when the rotor cage 34 is set in rotation, i.e. the screen unit 42 rotates automatically at the same speed as the rotor cage 34.

The rotor cage 34 is furthermore assigned a stationary base 50, which is arranged on an inner side of the second end area of the grinding container 12. The stationary base 50 is a circular element or tubular element 52, respectively, which protrudes perpendicularly from the second end area of the grinding container 12 into the grinding chamber 18 at least in sections. The circular or tubular element 52, respectively, has a bore, through which the shaft 20 is guided. An axial, second distance $A_2$ or gap, respectively, which is preferably smaller than 0.3-times the diameter of the grinding body, is formed between the grinding chamber-side free end or end face, respectively, of the circular or tubular element 52, respectively, and the disk 46, i.e. the second distance $A_2$ or gap, respectively, is formed in such a way that no grinding bodies and/or grinding material, which is not completely ground, reach into the grinding material outlet 16 without authorization.

Figure 2:
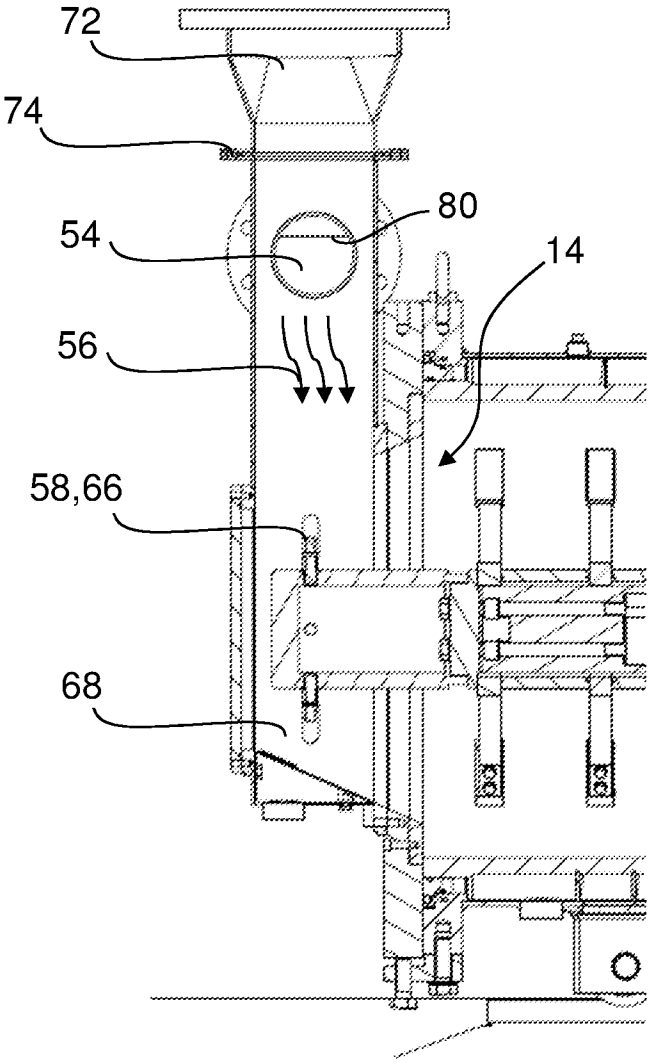
FIG. 2 shows a schematic detail view of the grinding material inlet of the agitator ball mill shown in FIG. 1.

FIG. 2 shows a schematic detail view of the grinding material inlet 14 from the agitator ball mill 10 shown in FIG. 1. The grinding material to be ground is stored in a storage container 72, which is formed in a funnel-shaped manner and which is connected to the grinding material inlet 14 via a grinding material inlet chamber 68. A gate 74 is provided at the lowest point of the storage container 72, in order to supply the grinding material stored in the storage container 72 to the grinding material inlet 14 in the grinding chamber 18 via the grinding material inlet chamber 68. The grinding material is in particular supplied to the grinding material inlet 14 by means of gravity.

To control and to support the supply of the grinding material, the grinding material inlet 14, in particular the grinding material inlet chamber 68, is assigned a first fluid inlet opening 54, via which a first fluid flow 56 (illustrated by arrows), such as, for example, a first air volume flow, is supplied into the grinding material inlet 14 and thus into the grinding chamber 18. It would alternatively also be conceivable to use an inert or reactive gas. The first fluid flow 56 can mix with the grinding material, so that a first grinding material fluid flow, in particular a first grinding material air volume flow, is formed. The first fluid flow 56 is metered in such a way that the negative pressure, which prevails in the grinding container 12 or in the grinding chamber 18, respectively, is not impacted, but is sufficient for transporting the grinding material into the grinding container 12. The first fluid flow 56 is created via an external fluid source, such as, for example, an air source, which is not illustrated here.

It can optionally be provided that the first fluid inlet opening 54 comprises at least one control element 80, which is illustrated in FIG. 2, so that the first fluid flow 56 can be metered or regulated, respectively. A cross section of the first fluid inlet opening 54 can be changed, for example by means of the at least one control element 80.

To support the transport of the grinding material into the grinding chamber 18 and to prevent a clogging of the grinding material inlet 14, the shaft 20 in the grinding material inlet 14, which protrudes in particular into the grinding material inlet chamber 68, is formed as first screw conveyor 58, in particular as first helical screw 66, at least in sections.

Figure 3:
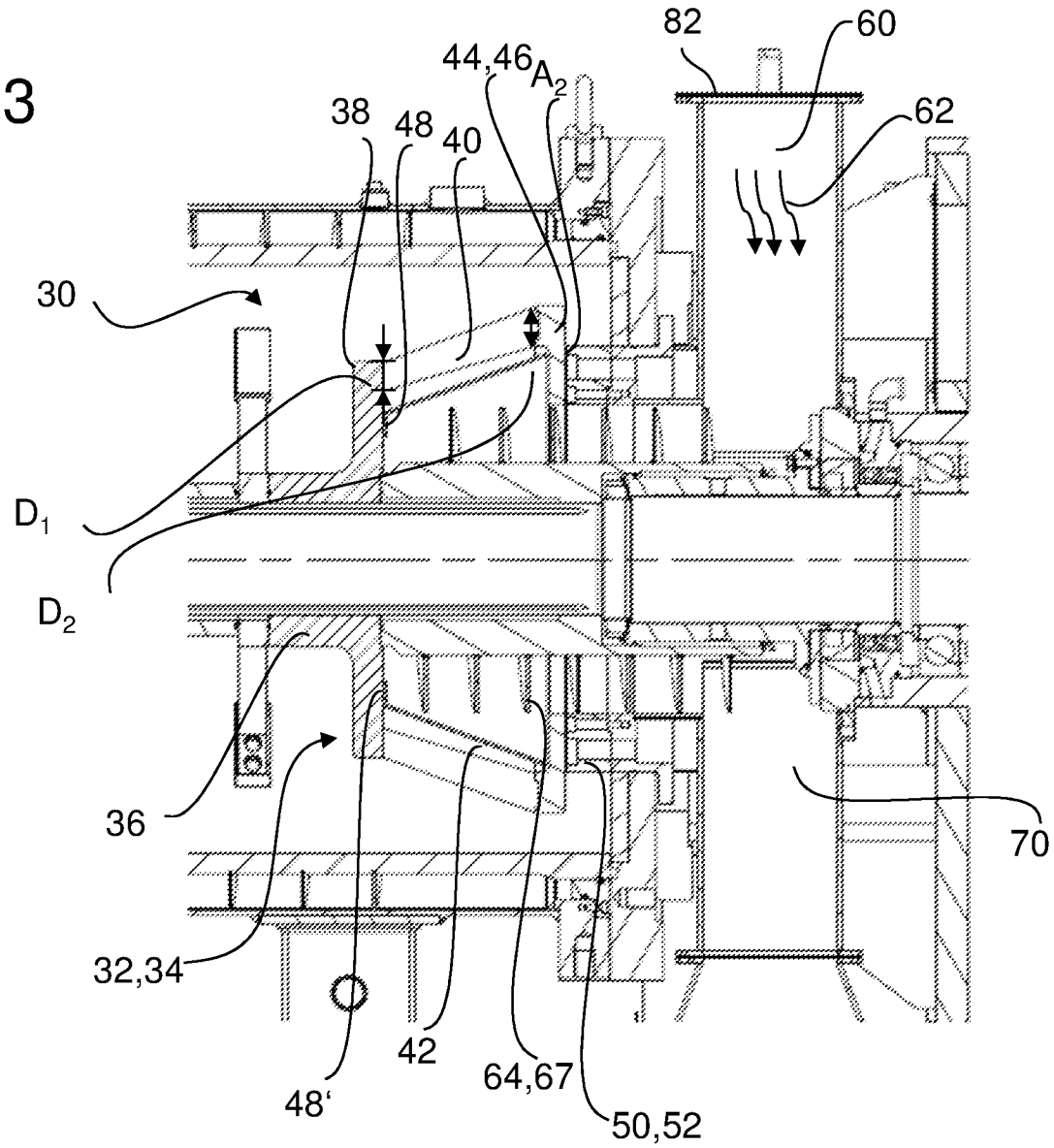
FIG. 3 shows a schematic detail view of the grinding material outlet comprising the separating device arranged upstream thereof from the agitator ball mill shown in FIG. 1.

FIG. 3 shows a schematic detail view of the grinding material outlet 16 comprising the separating device 30 arranged upstream thereof from the agitator ball mill 10 shown in FIG. 1. It becomes clear in FIG. 3 that the shaft 20, which protrudes within the screen unit 42 and into the grinding material outlet 16, is formed as second screw conveyor 64, in particular as second helical screw 67, at least in sections. The grinding material, which is allowed to pass through the screen unit 42 and which is ground completely, is thus moved and conveyed from the screen unit 42 along the grinding material outlet 16 or out of the grinding material outlet 16, respectively.

The grinding material outlet 16 extends parallel above and/or below the shaft 20 at least in sections, in particular towards the second screw conveyor 64, and leads into a grinding material outlet chamber 70 arranged spatially downstream from the grinding material outlet 16. Here, the grinding material outlet chamber 70 communicates with a non-illustrated collection container for the completely ground grinding material.

The grinding material outlet 16, in particular the grinding material outlet chamber 70, is assigned a second fluid inlet opening 60, via which a second fluid flow 62 (illustrated by arrows), such as, for example a second air volume flow, is supplied into the grinding material outlet 16 and thus also into the grinding material outlet chamber 70. It would alternatively also be conceivable to use an inert or reactive gas. On the one hand, the second fluid flow 62 serves as transport medium, which mixes with the completely ground grinding material, so that a second grinding material fluid flow, in particular a second grinding material air volume flow, is formed. The transport of the completely ground grinding material along the grinding material outlet 16 and of the grinding material outlet chamber 70 is thus supported by means of the second fluid flow 62. A clogging of the grinding material outlet 16 with grinding material is prevented at the same time.

As already mentioned in FIG. 1, an axial, second distance A2 or gap, respectively, which is preferably smaller than 0.3-times the diameter of the grinding body, is formed between the grinding chamber-side free end or end face, respectively, of the circular or tubular element 52, respectively, and the disk 46. This gap is preferably flushed through channels and/or bores in the tubular element 52, which are not illustrated here, by means of the second fluid flow and/or optionally by means of a third fluid flow (not illustrated here), such as, for example, a third air volume flow, so that no ground product or hardly completely ground product can penetrate into the gap.

In addition, the second fluid flow 62 and/or third fluid flow also acts as flushing fluid, in particular as flushing air, by means of which the screen unit 42 can be cleaned. In particular the openings of the screen unit 42, which are not illustrated here, can also be cleaned and blown out with the help of the flushing fluid.

The second fluid flow 62 is created via an external further fluid source, which is not illustrated here, in particular by means of an air source. The external fluid source can optionally be the same fluid source, which serves to create the first fluid flow 56.

The third fluid flow can be provided, for example, via a fluid source, which is not illustrated here, such as, for example, air source. The third fluid source can be a separate or external further fluid source, in particular air source. This fluid source can optionally be the same fluid source, which serves to create the first and/or second fluid flow 56, 62.

It can optionally be provided that the second fluid inlet opening 60 comprises a further control element 82, which is illustrated in FIG. 3, so that the second fluid flow 62 can be metered or regulated, respectively. A cross section of the second fluid inlet opening 60 can be changed for example by means of the control element 82. It is important to point out in particular, however, that the supplied second fluid flow 62 is in each case selected in such a way that the negative pressure, which prevails in the grinding container 12, is not impacted, but is sufficient for transporting the completely ground grinding material.

The embodiments, examples and alternatives of the preceding paragraphs, the claims or the following description and the figures, including the different views thereof or respective individual features can be used independently of one another or in any combination. Features, which are described in combination with an embodiment, can be applied for all embodiments, unless the features are incompatible.

When, in connection with the figures, reference is generally made to "schematic" illustrations and views, this does in no way suggest that the figure illustrations and the description thereof with regard to the disclosure of the invention are to be of minor importance. The person of skill in the art is in fact able to gather sufficient information from the illustrations, which are drawn schematically and in an abstract manner, which make it easier for him to understand the invention, without his understanding being impacted in any way from the illustrated and possibly not exactly true-to-scale size ratios of the agitator ball mill and/or parts of the agitator ball mill or other illustrated elements. The figures thus make it possible to the person of skill in the art, as reader, to derive a better understanding for the inventive idea, which is worded more generally and/or more abstractly in the claims as well as in the general part of the description, on the basis of the concretely described implementations of the method according to the invention and the concretely described mode of operation of the device according to the invention.

The invention has been described with reference to a preferred embodiment. A person of skill in the art can envision, however, that modifications or changes can be made to the invention, without thereby leaving the scope of protection of the claims below.

The invention claimed is:

1. An agitator ball mill comprising:

a horizontal grinding container, which has a first end area having a grinding material inlet and a second end area having a grinding material outlet, a shaft that is rotatable in a grinding chamber of the grinding container via a drive unit, at least a portion of the shaft is equipped with agitator elements, and a separating device including:

a classifier rotor, which is arranged on the shaft and axially spaced apart from the grinding material outlet and has a rotatable rotor cage, and a screen unit, which is arranged within the rotor cage and which is fastened to the classifier rotor such that the screen unit rotates with the rotor cage, wherein the screen unit has a smaller enveloping outer diameter on a side facing the grinding material inlet than on a side facing the grinding material outlet.

2. The agitator ball mill according to claim 1, wherein the rotor cage comprises:

a flange disposed on the shaft and including a support plate, and at least two rotor fingers fastened to the support plate.

3. The agitator ball mill according to claim 2, wherein the screen unit is fixed to the support plate of the flange.

4. The agitator ball mill according to claim 2, wherein the at least two rotor fingers have identical length in a longitudinal extension thereof.

5. The agitator ball mill according to claim 4, wherein the rotor cage comprises a ring element positioned at a free end of the at least two rotor fingers, and the classifier rotor has a smaller diameter in an area of the support plate than in an area of the ring element.

6. The agitator ball mill according to claim 4, wherein the at least two rotor fingers have a diameter, a width, or a height that increases along the longitudinal extension.

7. The agitator ball mill according to claim 4, wherein the at least two rotor fingers have a diameter, a width, or a height that is identical along the longitudinal extension.

8. The agitator ball mill according to claim 1, wherein the rotor cage is positioned adjacent to a stationary base, which is arranged on an inner side of the second end area of the grinding container and protrudes into the grinding chamber.

9. The agitator ball mill according to claim 8, wherein the stationary base includes channels that provide a fluid flow, which is smaller than 25% of the entire fluid flow.

10. The agitator ball mill according to claim 1, wherein the screen unit comprises openings, and wherein an opening width of the openings is smaller than 70% of a size of a grinding body.

11. The agitator ball mill according to claim 1, wherein a grinding material inlet chamber is arranged spatially upstream of the grinding material inlet, and/or wherein a grinding material outlet chamber is arranged spatially downstream from the grinding material outlet.

12. The agitator ball mill according to claim 11, wherein the shaft arranged in the grinding container extends into the grinding material inlet or extends into the grinding material inlet and the grinding material inlet chamber.

13. The agitator ball mill according to claim 12, wherein the shaft within the grinding material inlet or within the grinding material inlet and the grinding material inlet chamber is formed as first screw conveyor.

14. The agitator ball mill according to claim 11, wherein the grinding material inlet or the grinding material inlet chamber includes a first fluid inlet opening, via which a first fluid flow is supplied to the grinding material inlet chamber and to the grinding material inlet.

15. The agitator ball mill according to claim 11, wherein the grinding material outlet or the grinding material outlet chamber includes a fluid inlet opening, via which a fluid flow can be supplied to the grinding material outlet chamber and to the grinding material outlet.

16. The agitator ball mill according to claim 15, wherein the fluid inlet opening has at least one control element to adjust a cross section of the fluid inlet opening, thereby regulating the second fluid flow.

17. The agitator ball mill according to claim 14, wherein the first fluid inlet opening has at least one control element to adjust a cross section of the first fluid inlet opening, thereby regulating the first fluid flow.

18. The agitator ball mill according to claim 14, wherein the first fluid inlet opening is configured to provide the first fluid flow through the grinding material inlet chamber so that the first fluid flow is larger than 50% of the entire fluid flow.

19. The agitator ball mill according to claim 11, wherein the shaft arranged in the grinding container extends into the grinding material outlet or extends into the grinding material outlet and the grinding material outlet chamber.

20. The agitator ball mill according to claim 19, wherein the shaft within at least one of the screen unit, the grinding material outlet, or the grinding material outlet chamber is formed as a screw conveyor.

21. The agitator ball mill according to claim 1, wherein the shaft is cantilever-mounted, and wherein the grinding material inlet is arranged at a cantilevered end of the shaft and the grinding material outlet is arranged at a bearing-side end of the shaft.

22. A method for operating an agitator ball mill comprising a horizontal grinding container, which has a first end area having a grinding material inlet and a second end area having a grinding material outlet, the grinding container being filled with grinding bodies, the method including the steps of:

rotating a shaft in a grinding chamber of the grinding container using a drive unit, at least a portion of the shaft being equipped with agitator elements, separating comminuted material from the grinding bodies with a classifier rotor and a screen unit which has a smaller enveloping outer diameter on a side facing the grinding material inlet than on a side facing the grinding material outlet, the classifier rotor being arranged on the shaft and axially spaced apart from the grinding material outlet and having a rotatable rotor cage, and the screen unit being arranged within the rotor cage and fastened to the classifier rotor such that the screen unit rotates with the rotor cage.

* * * * *